US006484659B2

(12) United States Patent
Hobdy et al.

(10) Patent No.: US 6,484,659 B2
(45) Date of Patent: Nov. 26, 2002

(54) CHAIN TABLE ARRANGEMENT AND METHOD FOR INSTALLATION

(75) Inventors: Miles A. Hobdy, Houston, TX (US); L. Terry Boatman, Houston, TX (US)

(73) Assignee: FMC Technologies, Inc., DE (US)

( * ) Notice: Subject to any disclaimer, the term of this patent is extended or adjusted under 35 U.S.C. 154(b) by 0 days.

(21) Appl. No.: 10/103,497

(22) Filed: Mar. 18, 2002

(65) Prior Publication Data

US 2002/0134292 A1 Sep. 26, 2002

Related U.S. Application Data

(60) Provisional application No. 60/277,444, filed on Mar. 20, 2001.

(51) Int. Cl.[7] ..... B63B 21/00

(52) U.S. Cl. ..... 114/230.1; 114/230.12; 114/293

(58) Field of Search ..... 114/230.1, 293, 114/230.12

(56) References Cited

FOREIGN PATENT DOCUMENTS

JP 60-50096 * 3/1985

* cited by examiner

*Primary Examiner*—Ed Swinehart
(74) *Attorney, Agent, or Firm*—Gary L. Bush; Andrews & Kurth, LLP

(57) ABSTRACT

A chain table for connecting mooring legs to a turret. The chain table includes downwardly sloping connection flanges with bosses for forming holes for pivoting members of a coupler assembly. The downward slope of the flanges allows forces from connected anchor legs to be better directed to the chain table as compared to connecting flanges which extend perpendicularly from the body of the chain table. As a result, the chain table can be made smaller which allows it to be fabricated by casting techniques. An anchor leg pattern is established by connecting vessel end portions of anchor legs to the chain table while the vessel is in port, installing at a mooring site seabed portions of anchor legs according to an anchor leg pattern, and after the vessel arrives at the mooring site, connecting each vessel end portion to each corresponding seabed anchor leg portion to establish the anchor leg pattern for mooring the vessel.

11 Claims, 4 Drawing Sheets

CHAIN TABLE ARRANGEMENT AND METHOD FOR INSTALLATION

CROSS REFERENCE TO RELATED APPLICATION

This application claims priority from Provisional Application No. 60/277,444 filed on Mar. 20, 2001.

BACKGROUND OF THE INVENTION

1. Field of the Invention

This invention concerns mooring systems for floating production, storage and offloading (FSPO) vessels and the like, which require anchoring to the seabed. In particular, the invention concerns chain tables by which anchor legs are secured to the vessel.

2. Description of the Prior Art

Prior art arrangements for turret moored vessels include a chain table secured to the bottom end of the turret by which anchor legs are coupled between the seabed and the turret. Prior arrangements have included permanent securement between the bottom of the turret and the chain table. Other prior arrangements have provided a buoyant disconnectable chain table which sinks below the vessel on disconnection and provides for rapid disconnection of the vessel from its mooring.

FIGS. 1A and 1B of the drawings illustrate prior art arrangement for mooring a turret to the seabed with anchor legs. FIG. 1A from U.S. Pat. No. 4,606,727 is typical of some prior art chain tables for turrets in that horizontal flanges extend from the bottom of the turret for connection at 100 to anchor legs. Other turrets such as illustrated in FIG. 1B have several sockets arranged at the base of the turret with chain tubes and winches placed at an upper deck for pulling in anchor legs. The sockets are each arranged and designed to accept a fairlead or coupling assembly. The number of sockets available for the fairlead assemblies and the anchor legs is greater than the number of actual anchor legs which will be used to moor the vessel in order to provide flexibility in mooring patterns. Nevertheless, providing excessive numbers of chain pipes, sockets and fairleads is expensive in terms of cost and weight for the mooring system.

3. Identification of Objects of the Invention

A primary object of the invention is to provide an improved chain table by reducing the size, complexity and cost of the chain table described above.

Another object of the invention is to provide a simpler, less massive chain table as compared to prior art chain tables, thereby reducing the cost of a turret/chain table assembly.

Another object of the invention is to provide a lower cost chain table that can be configured to accept several arrangements of mooring lines, such that a single chain table design, for example, can be used for several turret/chain table mooring applications, each one with a different mooring line pattern.

Another object of the invention is to provide an improved chain table that is arranged to provide a reduction of size (as compared to prior chain tables) while being capable of handling expected mooring loads (for example, the same loads applied to the prior chain tables).

Another object of the invention is to provide a chain table for a turret of a turret moored system, where the reduction of size of the chain table, as compared to prior chain tables, enables fabrication by less expensive casting methods, rather than more expensive plate welding methods.

Another object of the invention is to provide a method of manufacturing a chain table by casting methods.

Another object of the invention is to provide a method for installing anchor legs of a turret by using a standardized chain table.

Another object of the invention is to provide a method for installing anchor legs of a turret moored vessel with partial connection of anchor leg portions at port and final installation of anchor legs at the mooring location.

SUMMARY OF THE INVENTION

The objects identified above, as well as other features and advantages of the invention, are provided in a cast chain table including a central ring and top and bottom outwardly extending flanges which are angled downwardly from a horizontal position of the ring that is attached to the bottom of the turret. The ring and flanges are preferably cast as one piece. A plurality of pairs of holes in the top and bottom flanges are provided to accept a shaft through a hole of a coupler assembly by which an anchor leg may be pivotally secured to the chain table. The downward angle of the top and bottom flanges aids in balancing anchor leg forces on the chain table (as compared to prior art arrangements).

According to another aspect of the invention, a method for installing anchor legs of a turret is provided by providing a standardized chain table with a plurality of bosses on a flange thereof and forming holes in certain of the bosses according to an anchor leg pattern for mooring the vessel at an offshore location.

According to another object of the invention, a method for installing anchor legs of a turret moored vessel is provided by first connecting vessel end portions of anchor legs to a chain table before the vessel arrives at the mooring site, installing a seabed portion of anchor legs according to a pre-established anchor leg pattern, and after the vessel arrives at the mooring site, connecting respective vessel end portions to seabed portions of the anchor legs.

BRIEF DESCRIPTION OF THE DRAWINGS

The invention will be described by reference to drawings of its preferred embodiment of which.

DESCRIPTION OF THE PREFERRED EMBODIMENT

Figure 2:
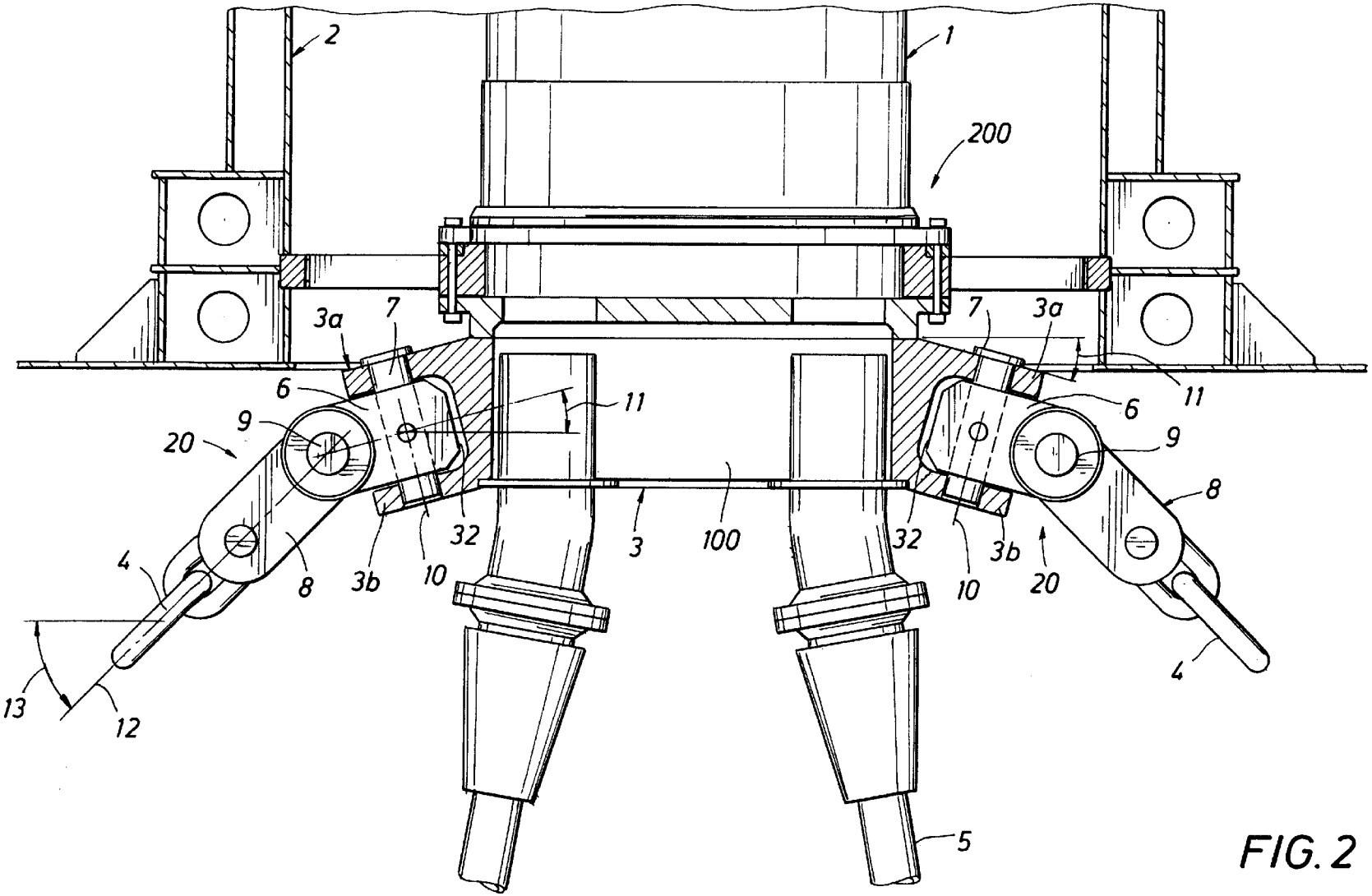
FIG. 2 is a side view, partially in section, of a chain table embodiment of this invention, showing it attached to the bottom of a turret of a permanently connected turret mooring arrangement.

FIG. 2 shows a lower portion of a moonpool 2 of a vessel which includes a turret 1 about which the vessel is rotatably supported. A chain table 3 according to the invention is secured (for example, by welding) to the lower end of the turret 1. The lower portion of turret 1 is rotationally supported by a radial bearing support assembly 200 which is described in co-pending U.S. non-provisional application Ser. No. 10/093,126 filed on Mar. 6, 2002. The upper portion of the turret (not shown) is rotationally supported by axial and radial bearing assemblies. Such application is incorporated herein for its detailed description of the lower bearing arrangement.

Figure 3:
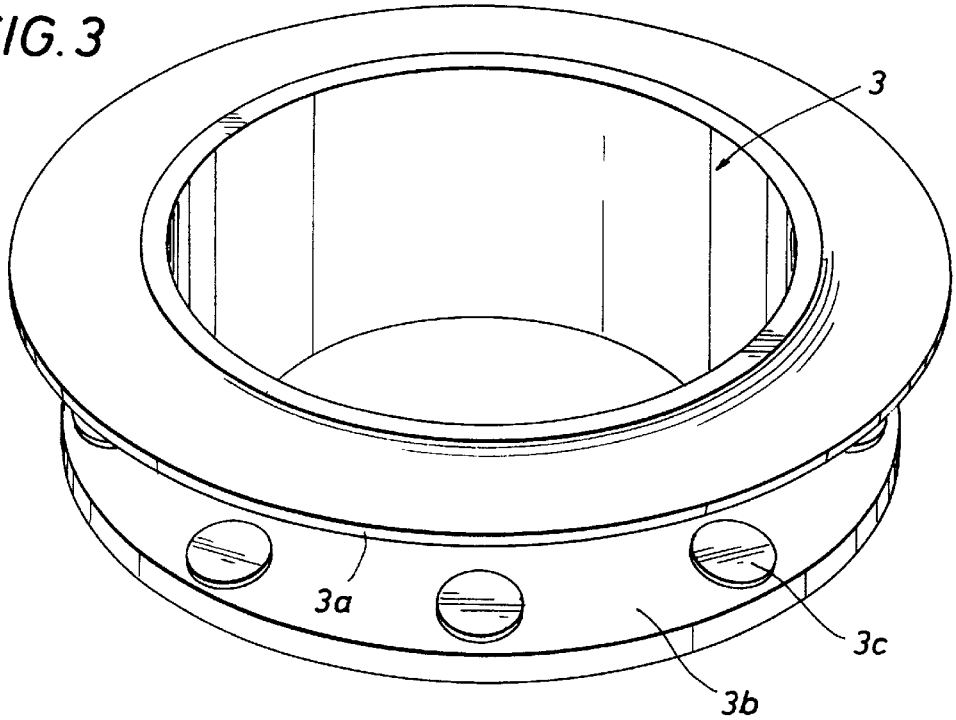
FIG. 3 is a perspective view of the ring and top and bottom flanges of the chain table.
Figure 4:
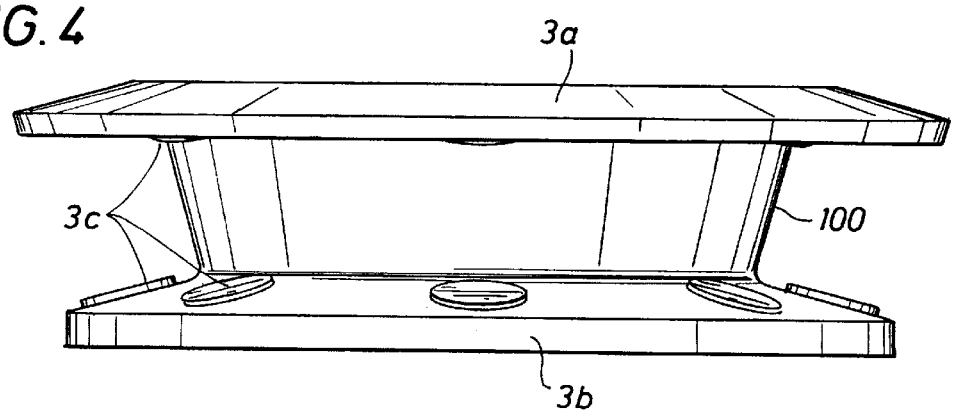
FIG. 4 is another perspective view of the ring and top and bottom flanges of the chain table and showing bosses on the flanges.

As shown in FIGS. 2, 3 and 4, the chain table 3 includes a cylindrical ring 100 with top and bottom flanges 3*a* and 3*b* which angle downward from the horizontal at an angle 11. A peripheral groove 32 is formed between the upper and lower flanges 3*a*, 3*b* and outwardly of the ring 100. The interior of the cylindrical ring 100 provides for passage for one or more fluid conduits or risers 5 from the interior of the turret 1 to the seabed below (not shown).

Each coupler assembly 20 is arranged to pivot about an axis 10 of a coupler shaft 7 which is journaled in registration with holes of the respective top and bottom flanges 3*a*, 3*b*. Axis 10 is perpendicular to the first pivoting part 6 of the fairlead assembly 20. Each coupler assembly 20 also includes a second pivoting part 8 which is capable of pivoting about a horizontal shaft 9 through first pivoting part 6. The anchor legs 4 are secured to the coupler assembly 20 at the second pivoting part 8.

As illustrated in FIG. 2, a load or force vector 12 forms an angle 13 with respect to the horizontal along the anchor leg 4. Such angle typically varies from 16 to 60 degrees, depending upon the depth of the water and the environmental forces applied to the vessel. The downward angle 11 of the top and bottom flanges 3*a*, 3*b* may vary from 10 to 40 degrees, depending upon the depth of the water for the mooring arrangement, to balance shear forces on the flanges 3*a*, 3*b* and as a result reduce the sizes of the flanges 3*a*, 3*b* and the ring 100 of the chain table.

Figure 2A:
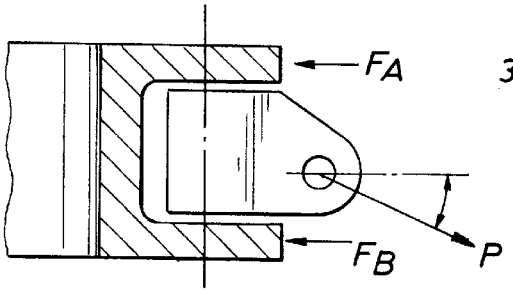
FIG. 2A (PRIOR ART)
FIGS. 2A and 2B are illustrations as to the improved balancing of forces on the top and bottom flanges of the chain table of the invention (FIG. 2B) as compared to the Prior Art (FIG. 2A)

The balancing of the reaction forces between the upper and lower flanges 3*a* and 3*b* is explained by reference to FIGS. 2A and 2B. FIG. 2A illustrates a prior art arrangement where top and bottom flanges of a chain table extend substantially horizontally from the central ring of the chain table. With the flanges arranged in a substantially horizontal position, a large imbalance exists between upper and lower flange reaction forces $F_A$, $F_B$ in response to an applied anchor leg force as represented by the vector P. Such large imbalance causes more wear on one of the bushings and more fatigue damage on one of the flanges over the design life of the equipment.

Figure 2B:
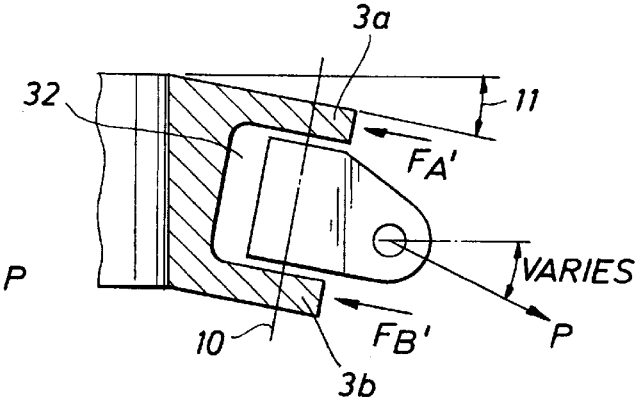

FIG. 2B illustrates that the upper and lower flanges 3*a*, 3*b*, according to the invention angle, extend downwardly at an angle 11 from the horizontal. As a result, the reaction forces $F'_A$ and $F'_B$ on the upper and lower flanges in response to the anchor leg force P are balanced more than for the case of FIG. 2A. As a result, better distribution of load force in the chain table and supporting hardware is achieved. Furthermore, bushing wear is reduced and more evenly distributed. Fatigue life of the structure is improved.

As illustrated in FIGS. 3 and 4, the chain table 3 can be fabricated by casting methods as a consequence of its reduction in size (as compared to prior chain tables fabricated by welding plates of steel), for a same level of anchor leg mooring forces. A casting of the chain table 3 is made by first making a mold and then pouring molten metal such as iron into the mold to produce the chain table of FIGS. 3 and 4. FIGS. 3 and 4 also show that bosses 3*c* can be provided in the casting on the top and bottom flanges 3*a*, 3*b* through which holes for the coupler shafts 7 may be formed, for example by boring. Alternatively, the bosses 3C may be eliminated from the top and bottom flanges 3*a*, 3*b* and holes provided as needed in the flanges in a pattern to match any anchor leg pattern. Another embodiment of the chain table 3 includes a raised ring (not shown) on the top and bottom flanges 3*a*, 3*b* through which holes for the coupler shafts 7 may be provided.

During assembly, the chain table 3 is first attached to the turret 1. The ends of the anchor legs 4 are attached to a coupler assembly including a first pivoting part 6 and a second pivoting part 8 which pivots about shaft 9. The assembly is then attached to chain table 3 by installing a coupler shaft 7 through top and bottom holes of flanges 3*a*, 3*b* and a corresponding hole of first pivoting part 6.

METHOD OF INSTALLATION OF ANCHOR LEGS

Figure 1A:
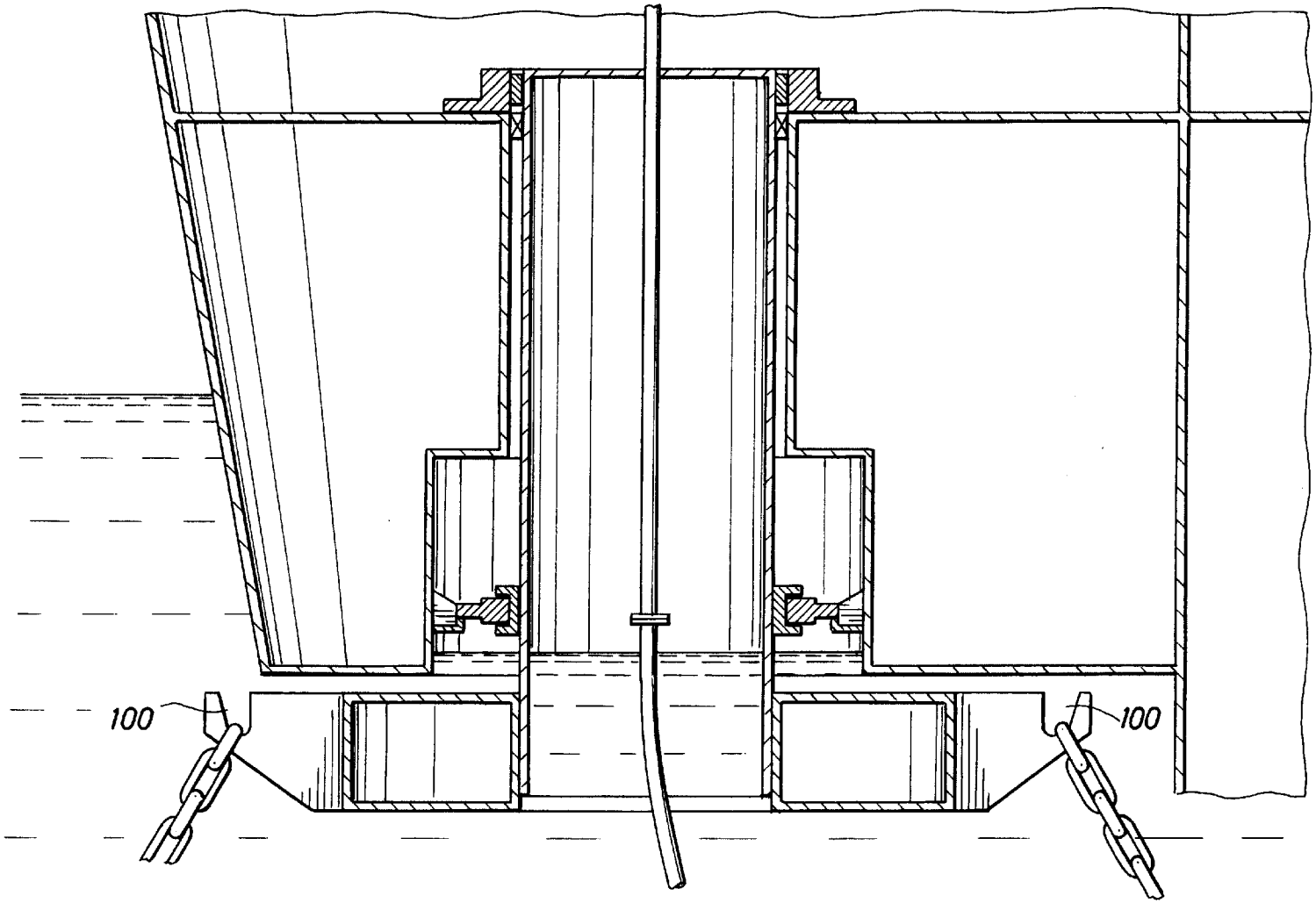
FIG. 1A (PRIOR ART)
FIGS. 1A and 1B illustrate prior art turret and chain table arrangements and methods for installing anchor legs to a vessel.
Figure 1B:
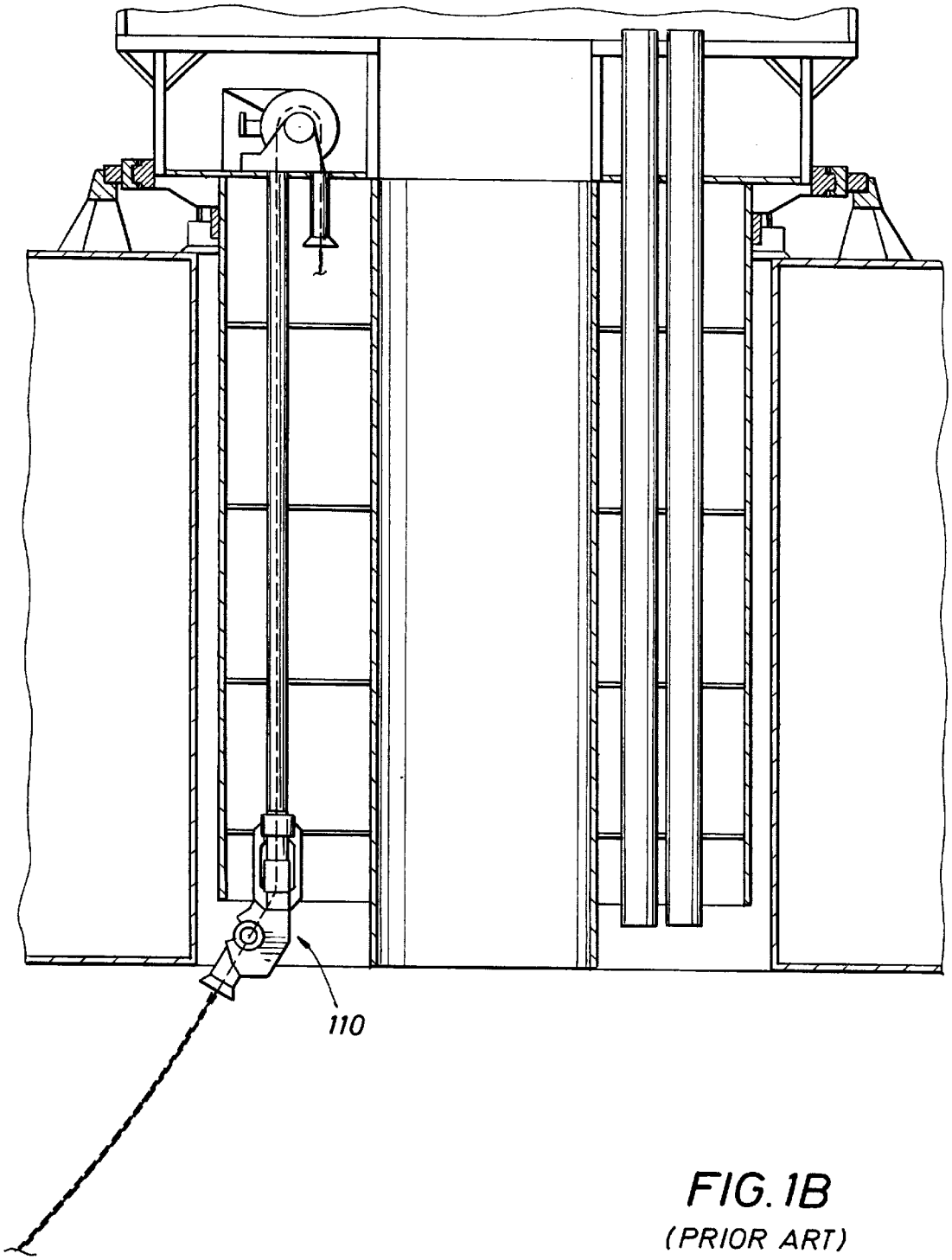
FIG. 1B (PRIOR ART)

The prior art arrangement of FIG. 1B provides anchor leg installation by pulling a portion of the anchor leg through chain pipes in the turret.

The new method of installation of anchor legs using the arrangement of FIG. 2 provides for pre-installing a length of anchor chain to the chain table prior to sailing from port to the offshore installation site. When the vessel arrives on site, a tug assists in making the final connection between the pre-installed vessel-end portion of the anchor leg and a seabed portion previously installed at the seabed at the site. The arrangement of FIG. 2 and the method of installation described above eliminate the need for providing many potential slots for locating anchor legs (as shown in FIG. 1) and eliminates the need for relatively large chain table structures.

The chain table of FIGS. 2, 3 and 4 is built by casting methods with blank bosses 3*c*, i.e., no connection holes are bored in the flanges for anchor leg connection hardware. As a result, a chain table ring 100 with upper and lower flanges 3*a*, 3*b* can be configured to a project specific anchor leg pattern by merely boring holes in the flanges as required by a new project anchor leg pattern. The structure and method of fabrication and installation is advantageous over the prior art arrangement of FIG. 1B in that redundant sockets and chain pipes are not required, while providing a new chain table and method of installation and fabrication which is stronger, and smaller in size as compared to the prior art structure of FIG. 1.

What is claimed is:

1. In a chain table for connecting mooring legs to a turret which is rotatable supported on a vessel, with the chain table having a central portion arranged and designed for securement to said turret with an outwardly extending member connected to said central portion, characterized by an improvement wherein, said central portion is a cylindrical ring having a cylindrical wall, and said outwardly extending member is a flange connected to said cylindrical wall, said flange sloping downwardly from said wall about the entire periphery of said ring.

2. The chain table of claim 1 wherein, said chain table with said improvement of a downwardly sloping outwardly extending member is an integral casting.

3. In a chain table for connecting mooring legs to a turret which is rotatably supported on a vessel, with the chain table having a central portion arranged and designed for securement to said turret with an outwardly extending member connected to said central portion, characterized by an improvement wherein, said outwardly extending member angles downwardly from said central portion, and said outwardly extending member includes upper and lower flanges each of which extend downwardly from said ring about the entire periphery of said ring.

4. The chain table of claim 3 wherein, said upper and lower flanges define a groove, said upper and lower flanges having aligned holes disposed therein, whereby a coupler assembly can be pivotably connected in said groove by means of a pivot pin through said holes and said coupler assembly.

5. The chain table of claim 3 wherein, said upper and lower flanges define a groove, said upper and lower flanges having aligned blank bosses disposed therein, whereby holes can be provided in aligned bosses as required for an anchor leg pattern.

6. A method of manufacturing a chain table for attaching mooring legs to a turret which is rotatably supported on a vessel where the chain table has a central portion arranged and designed for securement to said bottom of said turret, with an outwardly extending member connected to said ring, said outwardly extending member arranged and designed for connection with a coupler assembly, said method including the step of, creating a mold for said central portion and said outwardly extending member, and inserting molten metal into said mold to form an integral casting for said chain table, wherein, said central portion is a cylindrical ring defined by a central axis and a perpendicular plane which is perpendicular to said central axis, said outwardly extending member includes upper and lower flanges each of which extend downwardly from said perpendicular plane about the entire periphery of said ring, and said method is characterized by forming an integral casting for a chain table with said ring and said two outwardly and downwardly extending flanges.

7. The method of claim 6 wherein, blank bosses are formed in said flanges of said integral casting, where said upper and lower flanges define a groove, and where said bosses are aligned so that holes can be formed therein, whereby a coupler member can be pivotably connected in said groove by means of a pivot pin through said holes and said coupler member.

8. A method for installing anchor legs of a turret moored vessel comprising the steps of, while said vessel is in port, connecting a turret to a chain table with a central ring and outwardly extending upper and lower flanges, with said upper and lower flanges defining a peripheral groove about said central ring, said groove being arranged and designed to accept coupler members, and forming holes to define hole sets through said upper and lower flanges about the periphery of said chain table according to an anchor leg pattern for said vessel.

9. The method of claim 8 further comprising the steps of connecting vessel end portions of anchor legs corresponding to each leg of said anchor leg pattern at each of said hole sets to said chain table while said vessel is in port, before said vessel arrives at a mooring site, installing a seabed portion of anchor legs according to said anchor leg pattern, and after said vessel arrives on site, connecting each vessel leg portion to each corresponding seabed anchor leg portion to establish said anchor leg pattern for said vessel.

10. A method for installing anchor legs of a turret moored vessel according to an anchor leg pattern at a mooring site comprising the steps of, connecting a turret to a chain table, and connecting vessel end portions of anchor legs to said chain table corresponding to each leg of said anchor leg pattern while said vessel is in port, installing at a mooring site a seabed portion of anchor legs according to said anchor leg pattern, and connecting each vessel end portion to each corresponding seabed anchor leg portion to establish said anchor leg pattern for said vessel, when said vessel arrives at said mooring site.

11. The method of claim 10 wherein, said installing said seabed portion of anchor legs according to said anchor leg pattern is performed before said vessel arrives at said mooring site.

* * * * *